US009932738B2

(12) United States Patent
Sorkin

(10) Patent No.: US 9,932,738 B2
(45) Date of Patent: Apr. 3, 2018

(54) SHEATHING RETENTION CAPSULE

(71) Applicant: Felix Sorkin, Stafford, TX (US)

(72) Inventor: Felix Sorkin, Stafford, TX (US)

( * ) Notice: Subject to any disclaimer, the term of this patent is extended or adjusted under 35 U.S.C. 154(b) by 0 days.

(21) Appl. No.: 15/226,528

(22) Filed: Aug. 2, 2016

(65) Prior Publication Data

US 2017/0037625 A1 Feb. 9, 2017

Related U.S. Application Data

(60) Provisional application No. 62/200,959, filed on Aug. 4, 2015.

(51) Int. Cl.
*E04C 5/12* (2006.01)
*E04G 17/06* (2006.01)

(52) U.S. Cl.
CPC ..... *E04C 5/122* (2013.01); *E04G 17/06* (2013.01)

(58) Field of Classification Search
CPC ..... E04C 5/122; E04G 17/06
USPC ..... 52/223.13
See application file for complete search history.

(56) References Cited

U.S. PATENT DOCUMENTS 2,699,589 A * 1/1955 Redell ..... B66C 1/48 254/29 A
3,137,971 A 6/1964 Rhodes
3,685,934 A 8/1972 Huber et al.
3,766,609 A 10/1973 Brandestini et al.
3,956,797 A 5/1976 Brandestini et al.
4,363,462 A 12/1982 Wlodkowski et al.
4,388,014 A * 6/1983 Wlodkowski ..... E04C 5/122 403/369
4,633,540 A * 1/1987 Jungwirth ..... E01D 19/14 14/21
5,072,558 A 12/1991 Sorkin et al.
5,271,199 A 12/1993 Northern
5,594,977 A * 1/1997 McCallion ..... E04G 17/0707 24/115 M
5,630,301 A * 5/1997 Sieg ..... E04C 5/122 24/115 M
5,749,185 A 5/1998 Sorkin
5,755,065 A 5/1998 Sorkin
5,788,398 A 8/1998 Sorkin
5,897,102 A * 4/1999 Sorkin ..... E04C 5/12 249/43

(Continued)

FOREIGN PATENT DOCUMENTS

DE 3437107 A1 4/1986
FR 2708017 A1 1/1995

(Continued)

OTHER PUBLICATIONS

International Search Report and Written Opinion issued in PCT/US2016/045171, dated Nov. 3, 2016, 9 pages.

(Continued)

*Primary Examiner* — Paola Agudelo
(74) *Attorney, Agent, or Firm* — Adolph Locklar

(57) ABSTRACT

A sheathing retention capsule may include an outer body, the outer body having a tapered inner surface defining a forcing surface. The sheathing retention capsule may also include one or more holding wedges. At least one of the one or more holding wedges may have a tapered outer surface abutting the inner surface of the outer body. At least one of the one or more holding wedges may have an inner wall.

15 Claims, 6 Drawing Sheets

(56) References Cited

U.S. PATENT DOCUMENTS

| | | | | |
|---|---|---|---|---|
| 6,023,894 | A | 2/2000 | Sorkin | |
| 6,027,278 | A | 2/2000 | Sorkin | |
| 6,098,356 | A | 8/2000 | Sorkin | |
| 6,381,912 | B1 | 5/2002 | Sorkin | |
| 6,588,193 | B2 | 7/2003 | Hayes | |
| 6,631,596 | B1 | 10/2003 | Sorkin | |
| 6,684,585 | B2 * | 2/2004 | Campbell | E04C 5/08 403/2 |
| 6,761,002 | B1 | 7/2004 | Sorkin | |
| 6,883,280 | B2 | 4/2005 | Hayes | |
| 7,174,685 | B2 | 2/2007 | Hayes | |
| 7,216,842 | B2 | 5/2007 | Watson | |
| 7,275,347 | B2 | 10/2007 | Hayes | |
| 7,360,342 | B2 | 4/2008 | Hayes et al. | |
| 7,424,792 | B1 | 9/2008 | Sorkin | |
| 7,618,217 | B2 | 11/2009 | Henderson | |
| 7,621,103 | B1 | 11/2009 | Sorkin | |
| 7,676,997 | B1 | 3/2010 | Sorkin | |
| 7,726,082 | B2 | 6/2010 | Hayes et al. | |
| 7,762,029 | B2 | 7/2010 | Hayes et al. | |
| 7,765,752 | B2 | 8/2010 | Hayes et al. | |
| 7,793,473 | B2 | 9/2010 | Sorkin | |
| 7,797,895 | B1 | 9/2010 | Sorkin | |
| 7,823,345 | B1 * | 11/2010 | Sorkin | E04C 5/122 24/122.3 |
| 7,841,061 | B1 | 11/2010 | Sorkin | |
| 7,856,774 | B1 * | 12/2010 | Sorkin | E04C 5/122 24/122.6 |
| 7,866,009 | B1 | 1/2011 | Sorkin | |
| D635,278 | S | 3/2011 | Stanford | |
| 7,950,196 | B1 | 5/2011 | Sorkin | |
| 7,950,197 | B1 | 5/2011 | Sorkin | |
| 7,963,078 | B1 | 6/2011 | Sorkin | |
| 8,015,774 | B1 | 9/2011 | Sorkin | |
| 8,051,615 | B2 | 11/2011 | Mathews et al. | |
| 8,065,845 | B1 | 11/2011 | Sorkin | |
| 8,069,624 | B1 | 12/2011 | Sorkin | |
| 8,087,204 | B1 | 1/2012 | Sorkin | |
| 8,104,246 | B2 | 1/2012 | Nieto et al. | |
| 8,146,306 | B2 | 4/2012 | Hayes et al. | |
| 8,251,344 | B1 | 8/2012 | Sorkin | |
| 8,276,334 | B2 | 10/2012 | Mathews et al. | |
| 8,286,309 | B2 | 10/2012 | Landry | |
| 8,756,885 | B1 | 6/2014 | Mathews et al. | |
| 8,904,721 | B2 | 12/2014 | Pantelides et al. | |
| 8,925,279 | B2 | 1/2015 | Pantelides et al. | |
| 8,931,152 | B2 | 1/2015 | Parente et al. | |
| 9,096,986 | B2 | 8/2015 | Henderson | |
| 9,097,014 | B1 | 8/2015 | Sorkin | |
| 9,163,405 | B2 | 10/2015 | Mathews et al. | |
| 9,303,406 | B2 | 4/2016 | Sorkin | |
| 9,317,191 | B2 | 4/2016 | Stanford | |
| 9,399,869 | B2 | 7/2016 | Sorkin | |
| 2002/0007604 | A1 * | 1/2002 | Wallstein | E04C 5/122 52/223.13 |
| 2004/0148881 | A1 * | 8/2004 | Hayes | E04C 5/12 52/223.13 |
| 2006/0179742 | A1 | 8/2006 | Mathews et al. | |
| 2006/0201083 | A1 | 9/2006 | Hayes et al. | |
| 2008/0083130 | A1 | 4/2008 | Parkes et al. | |
| 2012/0011788 | A1 | 1/2012 | Nieto et al. | |
| 2012/0039672 | A1 | 2/2012 | Hall et al. | |
| 2015/0300021 | A1 | 10/2015 | Hayes | |
| 2015/0330078 | A1 | 11/2015 | Sorkin | |
| 2015/0345142 | A1 | 12/2015 | Mathews et al. | |
| 2016/0208490 | A1 | 7/2016 | Wilson | |

FOREIGN PATENT DOCUMENTS

| | | | |
|---|---|---|---|
| JP | 2007070917 | A | 3/2007 |
| KR | 101174206 | B1 | 8/2012 |
| WO | 2007066860 | A1 | 6/2007 |

OTHER PUBLICATIONS

European Search Report issued in Application No. 16182584.9, dated Oct. 28, 2016, 7 pages.

* cited by examiner

SHEATHING RETENTION CAPSULE

CROSS-REFERENCE TO RELATED APPLICATIONS

This application is a nonprovisional application that claims priority from U.S. provisional application No. 62/200,959, filed Aug. 4, 2015, which is hereby incorporated by reference in its entirety

TECHNICAL FIELD/FIELD OF THE DISCLOSURE

The present disclosure relates generally to post-tensioned, pre-stressed concrete construction. The present disclosure relates specifically to anchors for use therein.

BACKGROUND OF THE DISCLOSURE

Many structures are built using concrete, including, for instance, buildings, parking structures, apartments, condominiums, hotels, mixed-use structures, casinos, hospitals, medical buildings, government buildings, research/academic institutions, industrial buildings, malls, roads, bridges, pavement, tanks, reservoirs, silos, sports courts, and other structures.

Prestressed concrete is structural concrete in which internal stresses are introduced to reduce potential tensile stresses in the concrete resulting from applied loads; prestressing may be accomplished by post-tensioned prestressing or pre-tensioned prestressing. In post-tensioned prestressing, a tension member is tensioned after the concrete has attained a desired strength by use of a post-tensioning tendon. The post-tensioning tendon may include for example and without limitation, anchor assemblies, the tension member, and sheathes. Traditionally, a tension member is constructed of a material that can be elongated and may be a single or a multi-strand cable. Typically, the tension member may be formed from a metal or composite material, such as reinforced steel. The post-tensioning tendon conventionally includes an anchor assembly at each end. The post-tensioning tendon is fixedly coupled to a fixed anchor assembly positioned at one end of the post-tensioning tendon, the "fixed-end", and stressed at the stressed anchor assembly positioned at the opposite end of the post-tensioning tendon, the "stressing-end" of the post-tensioning tendon.

Post-tension members are conventionally formed from a strand and a sheath. The strand is conventionally formed as a single or multi-strand metal cable. The strand is conventionally encapsulated within a polymeric sheath extruded thereabout to, for example, prevent or retard corrosion of the metal strand by protecting the metal strand from exposure to corrosive or reactive fluids. Likewise, the sheath may prevent or retard concrete from bonding to the strand and preventing or restricting movement of the sheath during post-tensioning. The sheath may be filled with grease to further limit the exposure of the metal strand and allow for increased mobility. Because the metal strand and the polymeric sheath are formed from different materials, the thermal expansion and contraction rates of the metal strand and polymeric sheath may differ. During conventional manufacturing, the sheaths are formed by hot extrusion over the metal strand. When the tension members are coiled for transport and storage, uneven thermal contraction may occur as the tendon cools. When installed as a post-tensioning tendon in a pre-stressed concrete member, cooling of the sheath may cause separation of the sheath from an anchorage, potentially exposing the metal strand to corrosive or reactive fluids.

SUMMARY

The present disclosure provides for a sheathing retention capsule. The sheathing retention capsule includes an outer body, the outer body having a tapered inner surface defining a forcing surface. The sheathing retention capsule also includes one or more holding wedges. At least one of the one or more holding wedges has a tapered outer surface abutting the inner surface of the outer body. At least one of the one or more holding wedges has an inner wall.

The present disclosure also provides for a post-tensioning tendon. The post-tensioning tendon includes a tension member including a strand and a sheath, the sheath positioned about the sheath. The post-tensioning tendon also includes a first anchor coupled to a first end of the tension member and a second anchor coupled to a second end of the tension member. At least one anchor includes a tapered inner surface defining a forcing surface and one or more holding wedges. The one or more holding wedges have a tapered outer surface abutting the forcing surface. The one or more holding wedges have an inner wall.

The present disclosure also provides for a method of coupling a tension member to an anchor for forming a post-tensioning tendon. The method includes providing an anchor. The anchor includes a tapered inner surface defining a forcing surface and one or more holding wedges. At least one of the one or more holding wedges has a tapered outer surface abutting the forcing surface. At least one of the one or more holding wedges has an inner wall. The method also includes removing a portion of the sheath from a first end of the tension member and inserting the first end of the tension member into the anchor. The method also includes inserting the sheath into the one or more holding wedges and forming a press-fit between the sheath and the one or more holding wedges. The method also includes coupling the strand to the anchor.

The present disclosure additionally provides for a sheathing retention capsule. The sheathing retention capsule also includes an outer body, the outer body having a tapered inner surface defining a forcing surface. The sheathing retention capsule also includes a wedge. The wedge includes a wedged portion and a die face portion. The wedged portion has a tapered outer surface and a flat inner surface. The die face portion has a flat outer portion. The wedged portion and the die portion are bonded, and the wedge has an inner wall.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1A:
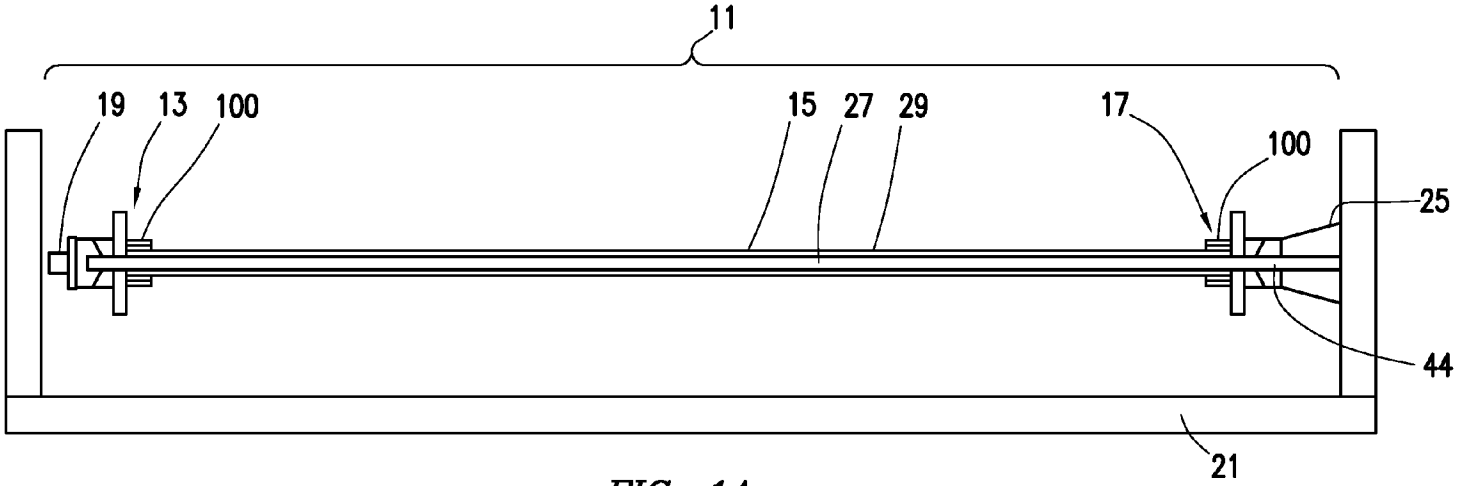
FIGS. 1A, 1B depict a partial cross section of a post-tensioning tendon within a concrete form during stages of a concrete pouring procedure consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 1B:
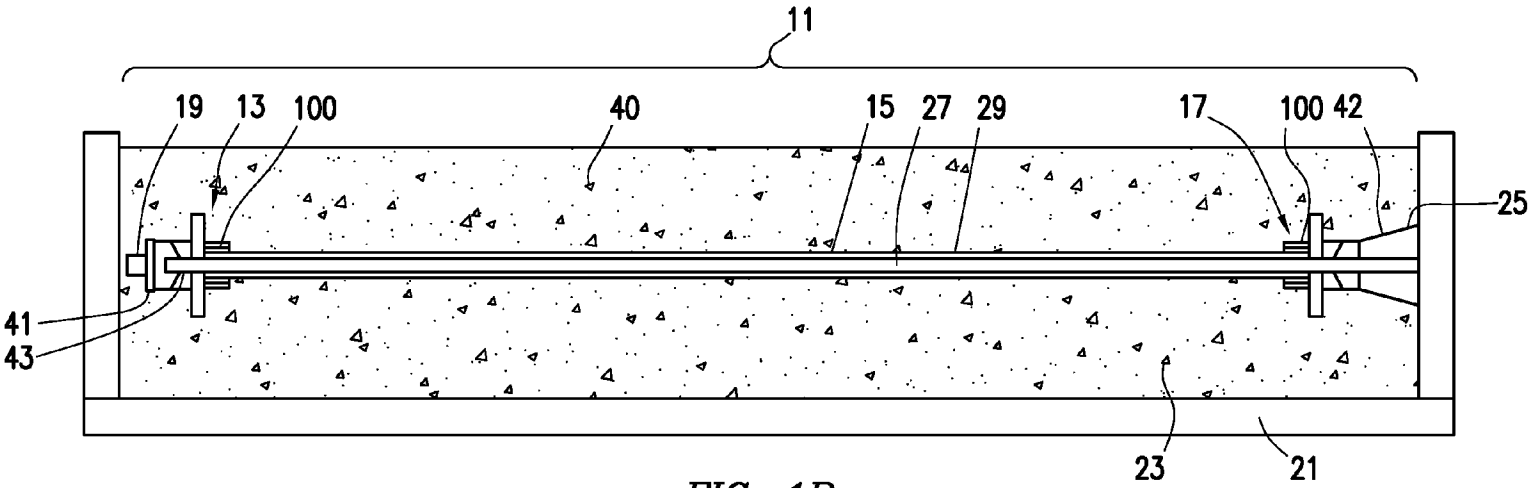

When stressing concrete member 40, anchoring systems may be provided to hold the tension member before and after stressing. In some embodiments, as depicted in FIGS. 1A, 1B, post-tensioning tendon 11 may be positioned within concrete form 21. Concrete form 21 is a form into which concrete may be poured to form concrete member 40. Post-tensioning tendon 11 may include for example and without limitation fixed end anchor 13, tension member 15, and stressing end anchor 17. As depicted in FIG. 1A, in some embodiments, fixed end anchor 13 may include fixed end anchor body 14. Fixed-end anchor body 14 may be positioned within concrete form 21 such that fixed-end anchor body 14 will be encased in concrete 23 after concrete is poured into concrete form 21. In some embodiments, fixed end cap 19 may be positioned at distal end 41 of fixed end anchor body 14. Fixed end cap 19 may, in certain embodiments, protect tension member 15 from corrosion after concrete 23 is poured by preventing or retarding corrosive or reactive fluids or concrete from contacting tension member 15.

Stressing end anchor 17 may be positioned within concrete form 21 such that it is substantially surrounded by concrete 23. Pocket former 25 may be positioned between stressing end anchor body 18 and end wall 22 of concrete form 21. Pocket former 25 may be adapted to, for example and without limitation, prevent or restrict concrete 23 from filling the space between stressing end anchor body 18 and end wall 22, thus forming a cavity or pocket in edge 42 of concrete member 40 formed by concrete 23 within concrete form 21. Pocket former 25 may thus allow access to tension member 15 from outside concrete member 40 once concrete member 40 is sufficiently hardened and end wall 22 is removed.

In some embodiments, tension member 15 may include strand 27 and sheath 29. Strand 27 may be a single or multi-strand metal cable. Sheath 29 may be tubular or generally tubular and may be positioned about strand 27. In some embodiments, space between strand 27 and sheath 29 may be filled or partially filled with a filler such as grease. When installing tension member 15, in some embodiments, a length of sheath 29 may be removed from first end 43 of tension member 15, exposing strand 27. Strand 27 may be inserted through fixed end anchor 13 until sheath 29 engages with sheathing retention capsule 100. Strand 27 may then be coupled to fixed end anchor 13 such as by the use of wedges. Tension member 15 may be positioned within concrete form 21 and tension member 15 may be cut to correspond with the length of concrete form 21. In some embodiments, a length of sheath 29 may be removed from second end 44 of tension member 15, exposing strand 27. Strand 27 may be inserted through stressing end anchor 17 until sheath 29 engages with sheathing retention capsule 100 within stressing end anchor 17.

Figure 2A:
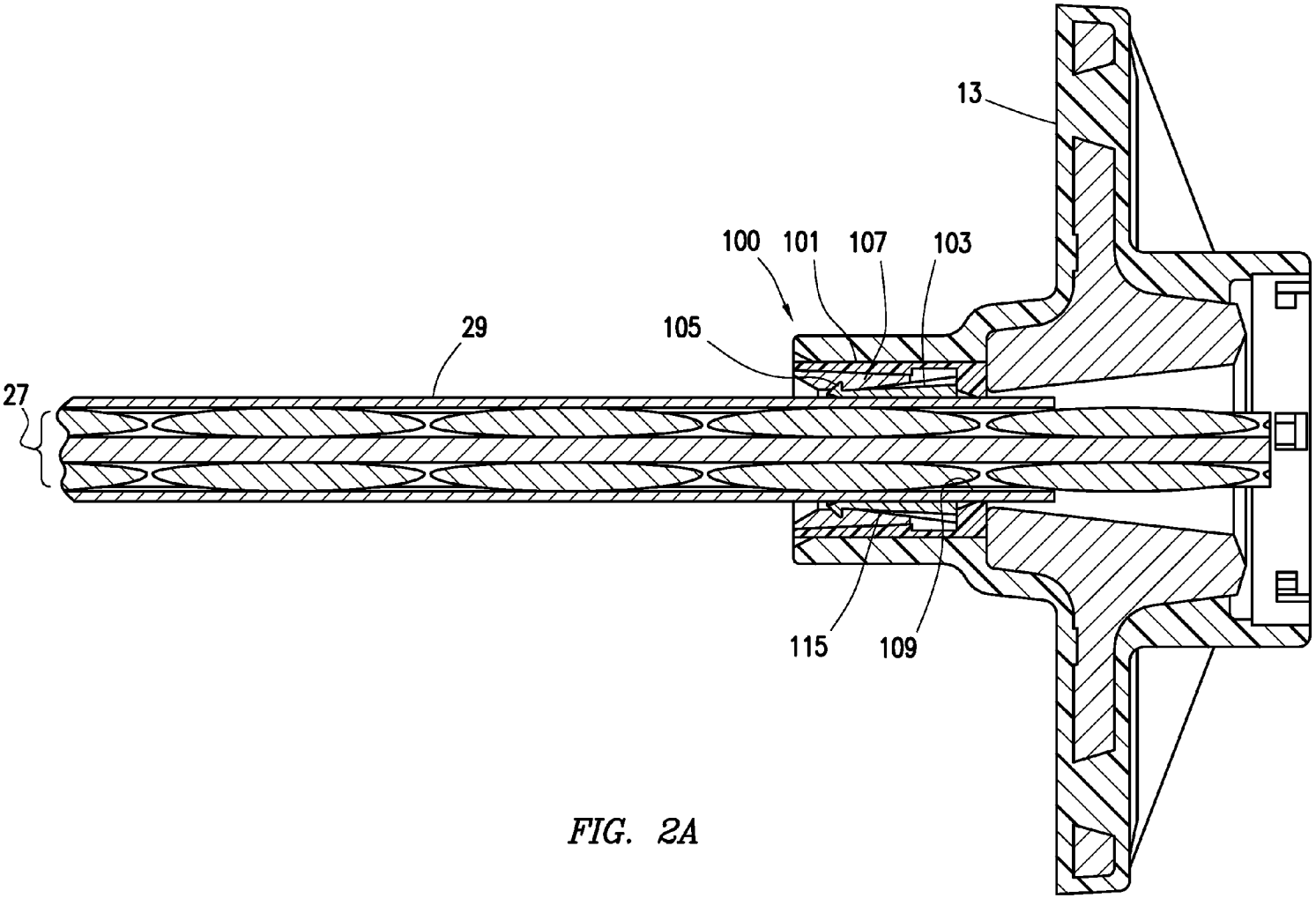
FIG. 2A depicts a cross section view of a fixed end anchor for a post tensioned concrete member including a sheathing retention capsule consistent with at least one embodiment of the present disclosure.
Figure 2B:
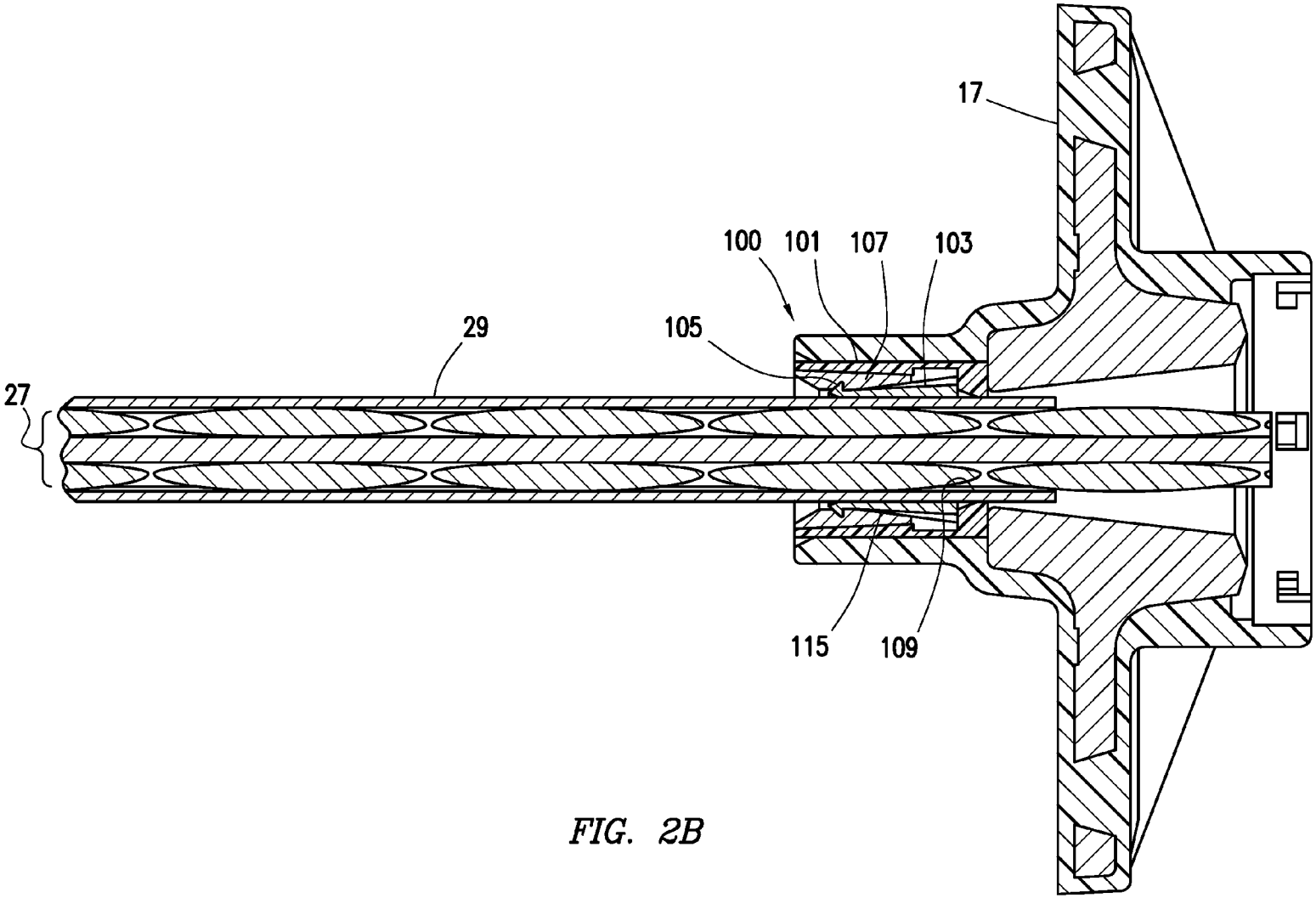
FIG. 2B depicts a cross section view of a stressing end anchor for a post tensioned concrete member including a sheathing retention capsule consistent with at least one embodiment of the present disclosure.
Figure 3:
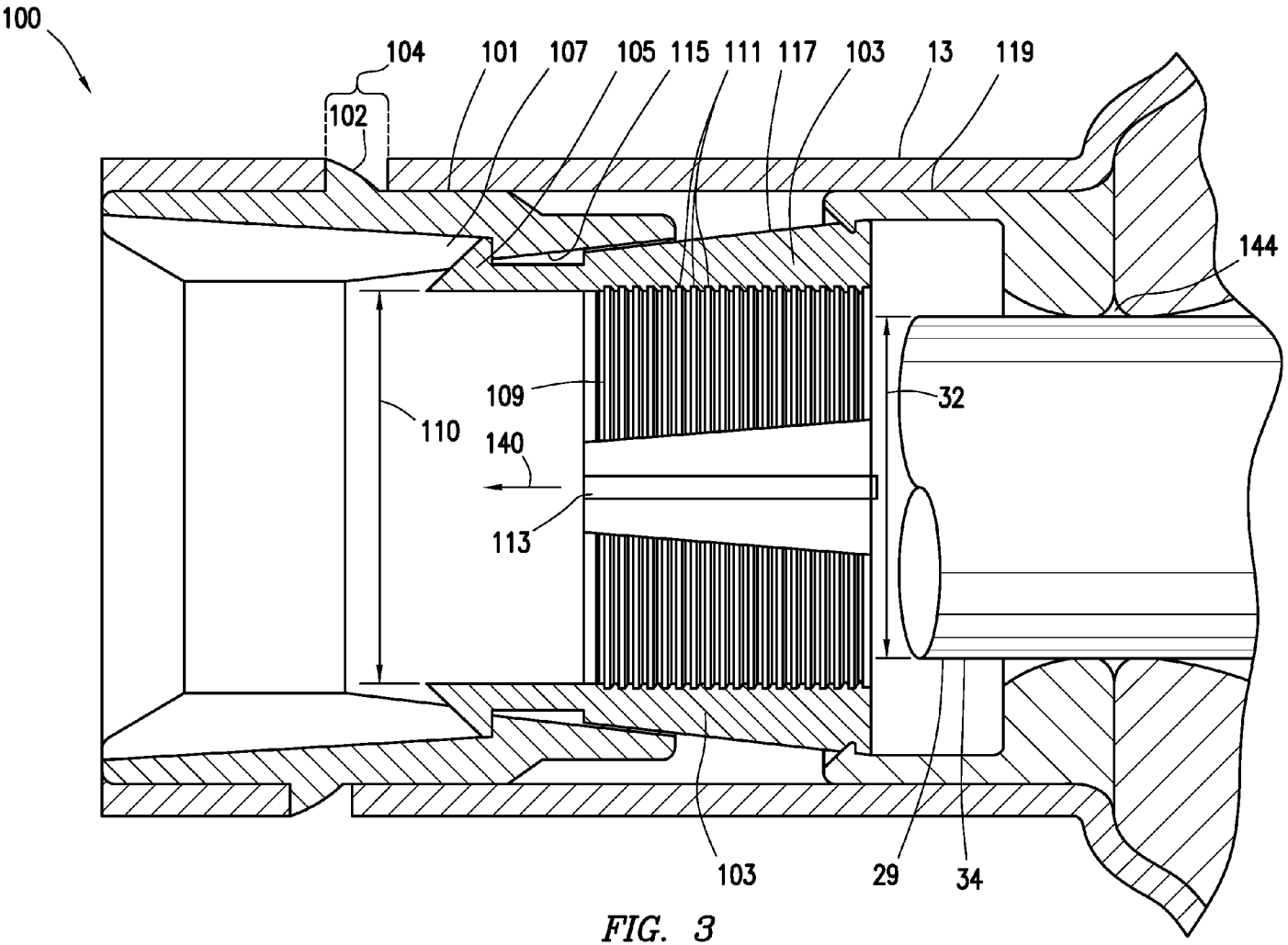
FIG. 3 depicts a cross section view of a sheathing retention capsule consistent with at least one embodiment of the present disclosure.

In some embodiments, as depicted in FIG. 2A, sheathing retention capsule 100 may be coupled to fixed end anchor 13. In some embodiments, as depicted in FIG. 2B, sheathing retention capsule 100 may be coupled to stressing end anchor 17. Although described hereinafter with respect to fixed end anchor 13, apparatuses, systems, and methods apply in the same manner with respect to stressing end anchor 17. Sheathing retention capsule 100 may couple to fixed end anchor 13 by a coupler, including but without limitation a thread, detent, press lock, or tab-and-slot connection. As depicted in FIG. 3, the coupler may be a tab-and-slot connection where sheathing retention capsule 100 may include one or more tabs 102 that fit into one or more corresponding anchor slots 104 formed in fixed end anchor 13. In some embodiments, tabs 102 may be wedge-shaped. When tabs 102 are wedge-shaped, sheathing retention capsule 100 may be inserted into fixed end anchor 13, but sheathing capsule 100 may be restricted or prevented from removal from fixed end anchor 13.

As depicted in FIGS. 2A, 2B, 3 sheathing retention capsule 100 may include outer body 101 and one or more holding wedges 103. Outer body 101 and at least one of one or more holding wedges 103 may be generally tubular in shape. In some embodiments, two or more holding wedges 103 may be interconnected to form a wedge ring. Outer body 101 may be a coupler for connecting to fixed end anchor 13. One or more holding wedges 103 may be positioned within outer body 101. In some embodiments, one or more holding wedges 103 may include one or more retention features to prevent or restrict the separation of one or more holding wedges 103 and outer body 101. Retention features may include, for example and without limitation, one or more detents, pins, slides, or, as depicted in FIGS. 2, 3, hooks 105. Hooks 105 may fit within outer body slots 107 formed in outer body 101.

At least one of one or more holding wedges 103 may include inner wall 109, which may be cylindrical. Inner wall 109 may have inner wall diameter 110 corresponding with outer diameter 32 of sheath 29. Inner wall 109 may form a press or friction fit when sheath 29 is inserted into one or more holding wedges 103. In some embodiments, as depicted in FIG. 3, one or more holding wedges 103 may include one or more surface features on inner wall 109, which may increase the static friction between outer wall 34 of sheath 29 and one or more holding wedges 103. In some embodiments, the surface features may include, for example and without limitation, wickers 111. Wickers 111 may be one or more grooves, protrusions, or teeth that may contact the outer wall of sheath 29 and, in some embodiments, press against or into outer wall 34 of sheath 29, thus increasing the retention force between one or more holding wedges 103 and sheath 29. In some embodiments, one or more holding wedges 103 may be at least partially split or may include expansion bridge 113. Expansion bridge 113 may allow at least one of one or more holding wedges 103 to at elastically deform when sheath 29 is inserted thereinto, providing normal force between one or more holding wedges 103 and sheath 29. The normal force may increase friction therebetween. In some embodiments, expansion bridge 113 may be a portion of one or more holding wedges 103 that is less thick than the remaining portion of one or more holding wedges 103. In some embodiments, expansion bridge 113, such as when one or more holding wedges 103 are a wedge ring, may be one or more gaps in the wedge ring.

Figure 4A:
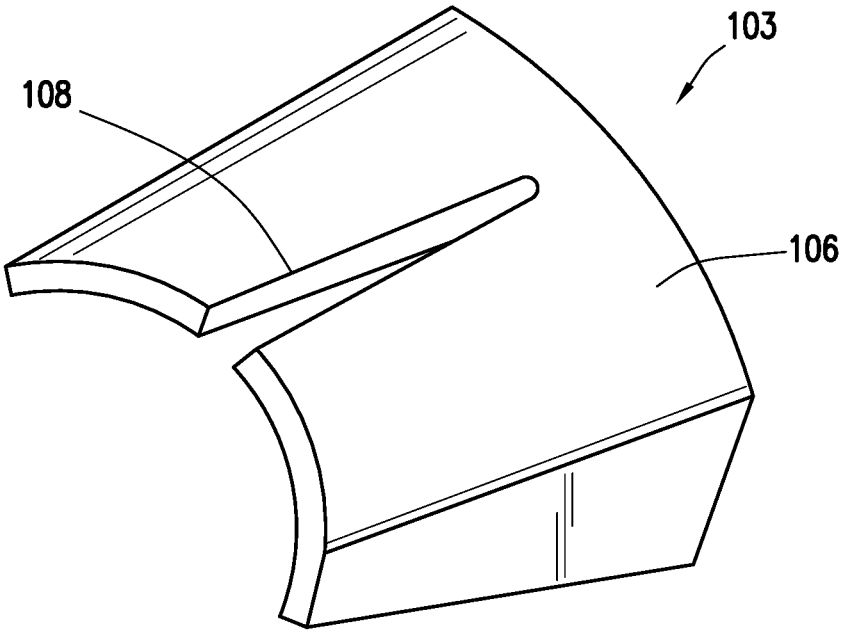
FIGS. 4A, 4B depict a wedge for use in a sheathing retention capsule consistent with at least one embodiment of the present disclosure.
Figure 4B:
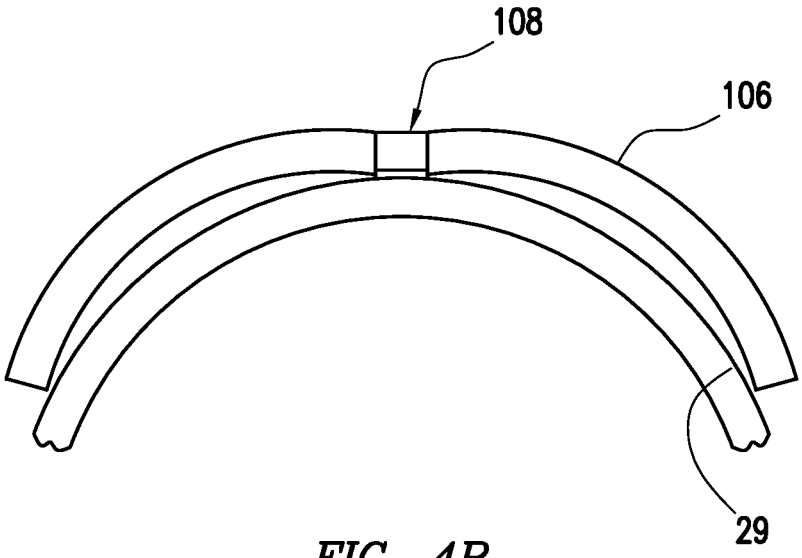

In some embodiments, one or more holding wedges 103 may be formed as one or more wedges 106 as depicted in FIG. 4A. At least one wedge 106 may be arcuate. In some embodiments, wedges 106 may include at least partial split 108 to allow wedge 106 to flex as depicted in FIG. 4B when compressed. This flexure may allow for deformation of wedge 106, and increased contact of wedge 106 with sheath 29. In some embodiments, the inner diameter of wedge 106 may be less than outer diameter 32 of sheath 29 to allow for a friction fit or press fit. The inner diameter of wedge 106 is the inner diameter of wedge 106 were it to extend circumferentially. Split 108 may allow deformation of wedge 106 to allow the inner diameter of wedge 106 thereof to more closely match outer diameter 32 of sheath 29.

Figure 5:
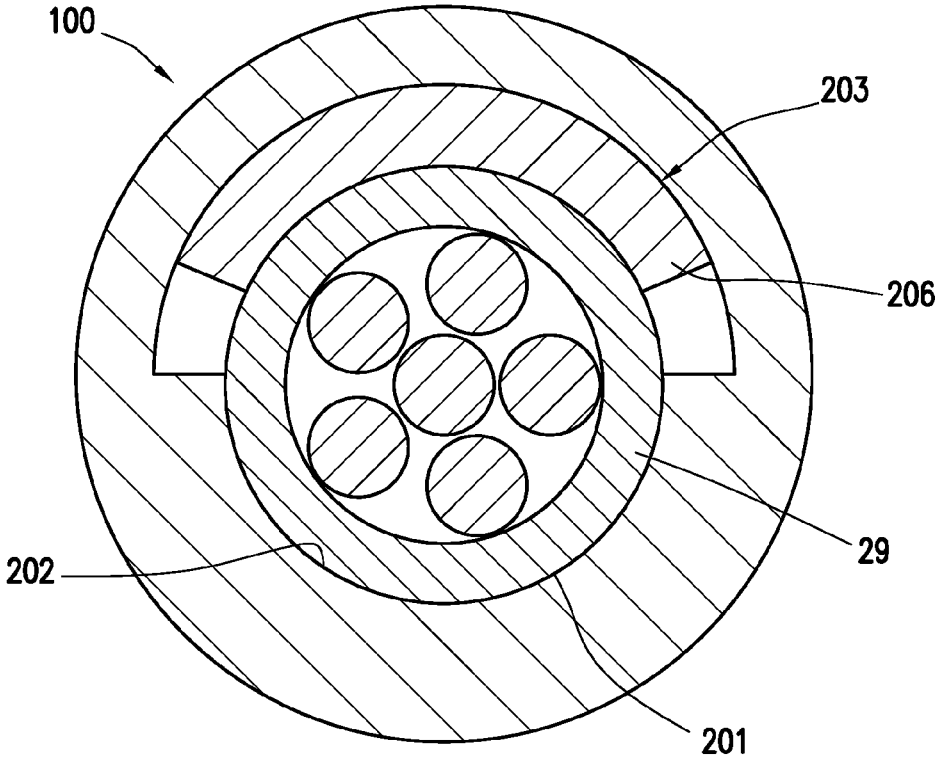
FIG. 5 depicts a cross section of a sheathing retention capsule consistent with at least one embodiment of the present disclosure.

In some embodiments, as depicted in FIG. 5, holding wedge 203 of sheathing retention capsule 200 may be positioned about only a portion of sheath 29. In some such embodiments, holding wedge 203 may be a single wedge 206. Wedge 206 may press against sheath 29 when compressed. In some embodiments, outer body 201 may include holding surface 202 positioned in opposition to wedge 206 to provide an opposing force on sheath 29 as wedge 206 engages sheath 29.

Figure 6:
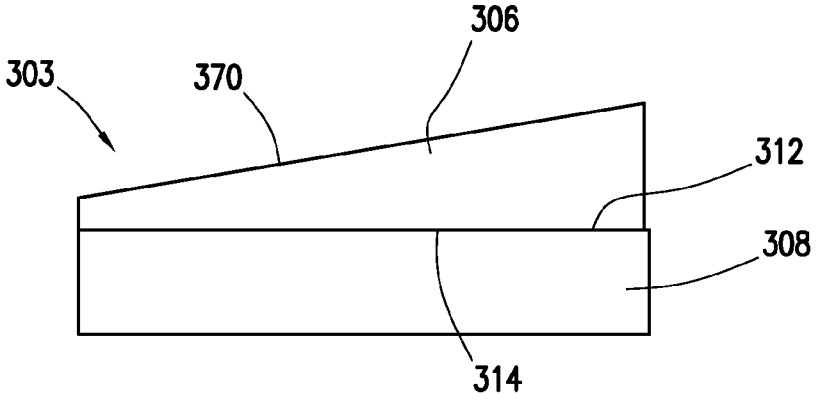
FIG. 6 depicts a wedge for use in a sheathing retention capsule consistent with at least one embodiment of the present disclosure.

In some embodiments, as depicted in FIG. 6, at least one of one or more holding wedges 303 may be formed from a plurality of pieces. In some embodiments, at least one of one or more holding wedges 303 may include wedged piece 306 and die face piece 308. Wedged piece 306 may have tapered outer surface 310 and flat inner surface 312, where outer surface 314 of die face piece 308 may be flat. In some embodiments, wedged piece 306 may be bonded to die face 308.

In some embodiments, outer body 101 may include a tapered inner surface defined herein as forcing surface 115. In some embodiments, forcing surface 115 may be frustoconically tapered. Forcing surface 115 may correspond to and abut tapered outer surface 117 of one or more holding wedges 103. Forcing surface 115 and outer surface 117 of one or more holding wedges 103 may allow one or more holding wedges 103 to be pulled further into outer body 101 as tension is applied to sheath 29. The taper of forcing surface 115 and outer surface 117 may bias one or more holding wedges 103 inward as shown by arrow 140, tightening the grip on sheath 29, until the reactant force, such as caused by material resistance to deformation, between forcing surface 115 and outer surface 117 is sufficient to resist the tension on sheath 29.

In some embodiments, sheathing retention capsule 100 may further include seal 119. Seal 119 may, as depicted in FIG. 3, be positioned to seal between sheath 29 and fixed end anchor 13. Seal 119 may be annular or generally annular and may fit into recess 144 formed in fixed end anchor 13. Seal 119 may protect tension member 15 from corrosion after concrete 23 (shown in FIG. 1B) is poured. Seal 119 may be positioned about an outer surface of outer body 101. Additionally, seal 119 may, for example, prevent or restrict concrete from ingressing into tension member 15.

Although described herein as a separate component from fixed end anchor 13, sheathing retention capsule 100 may be formed as a part of fixed end anchor 13. In such an embodiment, fixed end anchor 13 may include forcing surface 115, with one or more holding wedges 103, and, in some embodiments, seal 119 coupled thereto or formed therein.

Although described specifically with respect to fixed end anchor 13 and stressing end anchor 17, sheathing retention capsule 100 may be utilized with any anchor for a post-tensioned concrete member including an intermediate anchor. An intermediate anchor may be an anchor used between adjacent concrete members which are poured and stressed sequentially utilizing the same tension member 15.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure. Unless explicitly stated otherwise, nothing herein is intended to be a definition of any word or term as generally used by a person of ordinary skill in the art, and nothing herein is a disavowal of any scope of any word or term as generally used by a person of ordinary skill in the art.

The invention claimed is:

1. A sheathing retention capsule for use with a post-tensioning concrete anchor that engages the strand of a post-tensioning tendon that comprises a strand and a sheath surrounding the strand, the sheathing retention capsule comprising:

an outer body, the outer body having a tapered inner surface defining an inward-forcing surface and an outer surface, the outer surface being coupled to the anchor; and one or more holding wedges, at least one of the one or more holding wedges having a tapered outer surface abutting the tapered inner surface of the outer body, at least one of the one or more holding wedges having an inner wall, the inner wall directly engaging the sheath such that an application of tension to the sheath forces the holding wedges against the inward-forcing surface and therefore into tighter engagement with the sheath.

2. The sheathing retention capsule of claim 1 further comprising wickers positioned on the inner wall of at least one of the one or more holding wedges.

3. The sheathing retention capsule of claim 1, wherein the outer body further comprises a coupler that engages the anchor.

4. The sheathing retention capsule of claim 1, wherein the one or more holding wedges further comprises a hook that engages the outer body.

5. The sheathing retention capsule of claim 1 further comprising a seal, the seal positioned about the outer surface of the outer body.

6. The sheathing retention capsule of claim 1, wherein the one or more holding wedges further comprises an expansion bridge.

7. The sheathing retention capsule of claim 1 wherein at least one of the one or more holding wedges comprises a wedged piece and a die face piece, the wedged piece having a tapered outer surface and a flat inner surface, the die face piece having a flat outer surface, the wedged portion inner surface being bonded to the die face portion outer surface.

8. The sheathing retention capsule of claim 7, further comprising wickers positioned on the inner wall of the wedge.

9. The sheathing retention capsule of claim 7, wherein the outer body further comprises a coupler that engages the anchor.

10. The sheathing retention capsule of claim 7, wherein the wedge further comprises a partial slit.

11. A post-tensioning tendon comprising:

a tension member comprising a strand and a sheath, the sheath positioned about the strand;

a first anchor coupled to a first end of the strand and a second anchor coupled to a second end of the strand, at least one anchor including a sheathing retention capsule, the sheathing retention capsule comprising:

a tapered inner surface defining an inward-forcing surface; and one or more holding wedges, at least one of the one or more holding wedges having a tapered outer surface abutting the forcing surface, at least one of the one or more holding wedges having an inner wall, the inner wall directly engaging the sheath such that an application of tension to the sheath forces the holding wedges against the inward-forcing surface and therefore into tighter engagement with the sheath.

12. The post-tensioning tendon of claim 11, wherein the forcing surface is formed separately from the corresponding anchor and inserted thereinto.

13. The post-tensioning tendon of claim 11 further comprising wickers positioned on the inner wall of at least one of the one or more holding wedges.

14. The post-tensioning tendon of claim 11, wherein at least one of the first anchor or second anchor further comprises a seal, the seal positioned between the outer surface of the sheath and the first or second anchor.

15. The post-tensioning tendon of claim 11, wherein the one or more holding wedges further comprises an expansion bridge.

* * * * *